US008049506B2

(12) United States Patent
Lazarev

(10) Patent No.: US 8,049,506 B2
(45) Date of Patent: Nov. 1, 2011

(54) WIRED PIPE WITH WIRELESS JOINT TRANSCEIVER

(75) Inventor: Alexander Lazarev, Houston, TX (US)

(73) Assignee: Aquatic Company, Moscow (RU)

( * ) Notice: Subject to any disclaimer, the term of this patent is extended or adjusted under 35 U.S.C. 154(b) by 478 days.

(21) Appl. No.: 12/393,873

(22) Filed: Feb. 26, 2009

(65) Prior Publication Data

US 2010/0213942 A1 Aug. 26, 2010

(51) Int. Cl.
*G01V 3/00* (2006.01)

(52) U.S. Cl. ..... 324/333; 324/338; 175/40; 340/853.1

(58) Field of Classification Search ..... 324/333, 324/338; 175/40; 340/853.1
See application file for complete search history.

(56) References Cited

U.S. PATENT DOCUMENTS

| | | | |
|---|---|---|---|
| 296,547 | A | 4/1884 | Flad |
| 749,633 | A | 1/1904 | Seeley |
| 2,096,359 | A | 1/1936 | Hawthorn |
| 2,096,279 | A | 10/1937 | Karcher |
| 2,196,314 | A | 2/1938 | Lee |
| 2,339,274 | A | 8/1939 | Kothny |
| 2,197,392 | A | 11/1939 | Hawthorn |
| 2,301,783 | A | 3/1940 | Lee |
| 2,379,800 | A | 9/1941 | Hare |
| 2,414,719 | A | 4/1942 | Cloud |
| 2,370,818 | A | 7/1942 | Silverman |
| 2,748,358 | A | 5/1956 | Johnston |
| 3,090,031 | A | 5/1963 | Lord |
| 3,186,222 | A | 6/1965 | Martin |
| 3,194,886 | A | 7/1965 | Mason |
| 3,209,323 | A | 9/1965 | Grossman, Jr. |
| 3,518,608 | A | 6/1970 | Papadopoulos |
| 3,518,609 | A | 6/1970 | Fontenot, Jr. |
| 3,696,332 | A | 10/1972 | Dickson, Jr. et al. ..... 340/18 LD |
| 3,807,502 | A | 4/1974 | Heilhecker et al. ..... 166/315 |
| 3,825,078 | A | 7/1974 | Heilhecker et al. ..... 175/57 |
| 3,879,097 | A | 4/1975 | Oertle ..... 339/16 R |
| 3,904,840 | A | 9/1975 | Kostelnicek ..... 191/12 R |

(Continued)

FOREIGN PATENT DOCUMENTS

EP 0 371 906 A2 6/1990

(Continued)

OTHER PUBLICATIONS

Saputellil, L., et al., ADC/SPE 85314, "Real-time Decision-making for Value Creation while Drilling", Oct. 20-22, 2003.

(Continued)

*Primary Examiner* — Jay Patidar
(74) *Attorney, Agent, or Firm* — Wong, Cabello, Lutsch, Rutherford & Brucculeri, L.L.P.

(57) ABSTRACT

A wireless transceiver for transmitting data across a pipe joint is described herein. At least some illustrative embodiments include a wireless communication apparatus including a housing configured to be positioned inside/proximate of/to an end of a drill pipe. The housing includes an antenna with at least one RF signal propagation path parallel to the axis of the housing, and an RF module (coupled to the antenna) configured to couple to a communication cable, and to provide at least part of a data retransmission function between an antenna signal and a communication cable signal. A material (transparent to RF signals within the RF module's operating range) is positioned along the circumference, and at/near an axial end, of the housing closest to the antenna. At least some RF signals, axially propagated between the antenna and a region near said axial end, traverse the radiotransparent material along the propagation path.

38 Claims, 9 Drawing Sheets

U.S. PATENT DOCUMENTS 3,957,118 A 5/1976 Barry et al. ..... 166/315
3,993,944 A 11/1976 Meador et al. ..... 324/6
4,095,865 A 6/1978 Denison et al. ..... 339/16 R
4,181,184 A 1/1980 Scherbatskoy
4,220,381 A 9/1980 Van der Graaf
4,445,734 A 5/1984 Cunningham
4,523,141 A 6/1985 Thomas et al.
4,534,424 A 8/1985 Ramsey
4,605,268 A 8/1986 Meado ..... 339/16 C
4,691,203 A 9/1987 Rubin et al.
4,788,544 A 11/1988 Howard ..... 340/853
4,884,071 A 11/1989 Howard ..... 340/854
4,914,433 A 4/1990 Galle ..... 340/854
5,363,095 A 11/1994 Normann et al.
6,041,872 A 3/2000 Holcomb
6,367,565 B1 4/2002 Hall
6,392,317 B1 5/2002 Hall et al.
6,633,252 B2 10/2003 Stolarszyk et al.
6,641,434 B2 11/2003 Boyle et al.
6,655,453 B2 12/2003 Head
6,666,274 B2 12/2003 Hughes
6,670,880 B1 12/2003 Hall et al.
6,688,396 B2 2/2004 Floerke et al.
6,717,501 B2 4/2004 Hall et al.
6,766,141 B1 7/2004 Briles et al.
6,778,127 B2 8/2004 Storaczyk et al.
6,799,632 B2 10/2004 Hall et al.
6,821,147 B1 11/2004 Hall et al.
6,830,467 B2 12/2004 Hall et al.
6,844,498 B2 1/2005 Hall et al.
6,866,306 B2 3/2005 Boyle et al.
6,888,473 B1 5/2005 Hall et al. ..... 340/854.4
6,903,660 B2 6/2005 Clark et al.
6,913,093 B2 7/2005 Hall et al. ..... 175/57
6,929,493 B2 8/2005 Hall et al.
6,945,802 B2 9/2005 Hall et al.
6,987,463 B2 1/2006 Beique et al. ..... 340/856.3
6,992,554 B2 1/2006 Hall et al. ..... 336/90
7,002,445 B2 2/2006 Hall et al. ..... 336/132
7,017,667 B2 3/2006 Hall et al. ..... 166/380
7,026,819 B2 4/2006 Eidesmo et al. ..... 324/337
7,040,003 B2 5/2006 Hall et al. ..... 29/602.1
7,040,415 B2 5/2006 Boyle et al. ..... 175/40
7,041,908 B2 5/2006 Hall et al. ..... 174/75 C
7,042,367 B2 5/2006 Gardner et al. ..... 340/853.3
7,053,788 B2 5/2006 Hall et al.
7,064,676 B2 6/2006 Hall et al. ..... 340/853.1
7,069,999 B2 7/2006 Hall et al. ..... 166/380
7,080,998 B2 7/2006 Hall et al. ..... 439/191
7,091,810 B2 8/2006 Hall et al. ..... 336/132
7,093,654 B2 8/2006 Hall et al. ..... 166/242.6
7,096,961 B2 8/2006 Clark et al. ..... 166/380
7,098,802 B2 8/2006 Hall et al. ..... 340/854.3
7,139,218 B2 11/2006 Hall et al. ..... 367/82
7,156,676 B2 1/2007 Reynolds, Jr. ..... 439/194
7,163,065 B2 1/2007 Zhang et al. ..... 166/385
7,190,280 B2 3/2007 Hall et al. ..... 340/855.1
7,193,526 B2 3/2007 Hall et al. ..... 340/853.7
7,193,527 B2 3/2007 Hall et al. ..... 340/854.3
7,198,118 B2 4/2007 Hall et al. ..... 175/40
7,201,240 B2 4/2007 Hall et al. ..... 175/320
7,224,288 B2 5/2007 Hall et al. ..... 340/853.7
7,226,090 B2 6/2007 Hughes ..... 285/330
7,228,902 B2 6/2007 Oppelt ..... 166/250.02
7,230,541 B2 6/2007 Ripolone et al. ..... 340/853.2
7,230,542 B2 6/2007 Smits et al. ..... 340/853.9
7,243,717 B2 7/2007 Hall et al. ..... 166/242.2
7,248,177 B2 7/2007 Hall et al. ..... 340/854.8
7,248,178 B2 7/2007 Layton ..... 340/854.9
7,253,745 B2 8/2007 Hall et al. ..... 340/854.4
7,256,706 B2 8/2007 Haase et al. ..... 340/854.3
7,256,707 B2 8/2007 Clark et al. ..... 340/854.4
7,261,154 B2 8/2007 Hall et al. ..... 166/242.2
7,268,697 B2 9/2007 Hall et al. ..... 340/854.8
7,277,026 B2 10/2007 Hall et al. ..... 340/854.8
7,291,028 B2 11/2007 Hall et al. ..... 439/194
7,291,303 B2 11/2007 Hall et al. ..... 264/272.11
7,298,287 B2 11/2007 Hall et al. ..... 340/854.4
7,301,474 B2 11/2007 Zimmerman ..... 340/854.6
7,303,022 B2 12/2007 Tilton et al. ..... 166/380
7,319,410 B2 1/2008 Hall et al. ..... 340/854.8
7,327,634 B2 2/2008 Perry et al. ..... 367/84
7,336,199 B2 2/2008 Lasater et al. ..... 340/854.8
7,347,271 B2 3/2008 Ohmer et al. ..... 166/366
7,348,781 B2 3/2008 Tabanou et al. ..... 324/333
7,348,892 B2 3/2008 Rodney ..... 340/853.1
7,348,894 B2 3/2008 Bailey et al. ..... 340/854.3
7,350,565 B2 4/2008 Hall et al. ..... 166/242.1
7,350,589 B2 4/2008 Head ..... 166/385
7,379,883 B2 5/2008 Sorrells ..... 705/1
7,382,273 B2 6/2008 Hall et al. ..... 340/854.8
7,390,032 B2 6/2008 Hughes ..... 285/330
7,398,837 B2 7/2008 Hall et al. ..... 175/50
7,404,725 B2 7/2008 Hall et al. ..... 439/194
7,416,028 B2 8/2008 Prendin et al. ..... 166/381
2003/0102995 A1 6/2003 Stolarczyk et al. ..... 342/22
2003/0107511 A1 6/2003 Stolarczyk et al.
2004/0164838 A1 8/2004 Hall et al.
2005/0001738 A1 1/2005 Hall et al.
2005/0046586 A1 3/2005 Hall et al.
2005/0056419 A1 3/2005 Hosie et al.
2005/0074988 A1 4/2005 Hall et al.
2005/0161231 A1 7/2005 Prendin et al.
2005/0279508 A1 12/2005 Hall et al.
2006/0033637 A1 2/2006 Hall et al. ..... 340/853.1
2006/0158296 A1 7/2006 Hall et al. ..... 336/130
2006/0290528 A1 12/2006 MacPherson et al. ..... 340/853.1
2007/0023185 A1 2/2007 Hall et al. ..... 166/255.1
2007/0029112 A1 2/2007 Li et al. ..... 175/26
2007/0030167 A1 2/2007 Li et al. ..... 340/855.1
2007/0062692 A1 3/2007 Estevez et al. ..... 166/250.01
2007/0126596 A1 6/2007 Hall et al. ..... 340/854.9
2007/0137853 A1 6/2007 Zhang et al. ..... 166/65.1
2007/0169929 A1 7/2007 Hall et al. ..... 166/65.1
2007/0247329 A1 10/2007 Petrivic et al. ..... 340/854.4
2007/0247330 A1 10/2007 Clark ..... 340/854.6
2007/0257811 A1 11/2007 Hall et al. ..... 340/854.6
2007/0257812 A1 11/2007 Lasater et al. ..... 340/854.8
2008/0003856 A1 1/2008 Hall et al. ..... 439/191
2008/0007421 A1 1/2008 Liu et al. ..... 340/853.3
2008/0024318 A1 1/2008 Hall et al. ..... 340/853.3
2008/0041575 A1 2/2008 Clark et al. ..... 166/65.1
2008/0061789 A1 3/2008 Coates et al. ..... 324/333
2008/0068209 A1 3/2008 Sugiyama et al. ..... 340/853.2
2008/0099197 A1 5/2008 Payne ..... 166/250.01
2008/0106433 A1 5/2008 Madhavan et al. ..... 340/854.4
2008/0106972 A1 5/2008 Liang et al. ..... 367/25
2008/0158005 A1 7/2008 Santoso et al. ..... 340/854.4
2008/0191900 A1 8/2008 Camwell et al. ..... 340/854.3

FOREIGN PATENT DOCUMENTS

EP 1 332 270 B1 8/2007

OTHER PUBLICATIONS

Rommetveit, R., et al., IADC/SPE 112533, "Real-Time, 3D Visualization Drilling Supervision System Targets ECD, Downhole Pressure Control", Simulation, Internet article located at http://www.drillingcontractor.org/index/index2.php?option=com_content &task=view&id=....

Ali, T.H., et al., IADC/SPE 112636, "High Speed Telemetry Drill Pipe Network Optimizes Drilling Dynamics and Wellbore Placement", IntelliServ, Copyright 2008, IADC/SPE Conference. Conference held in Orlando, Florida, U.S.A. Mar. 4-5, 2008.

Olberg, T.S., et al., IADC/SPE 112702, "The Utilization of the Massive Amount of Real-Time Data Acquired in Wired-Drillpipe Operations", Copyright 2008, IADC/SPE Drilling Conference. Conference held in Orlando, Florida, U.S.A., Mar. 4-6, 2008.

Nygard, V., et al., IADC/SPE 112742, "A Step Change in Total System Approach Through Wired-Drllpipe Technology".

Klotz, C., et al., IADC/SPE 112683, "A New Mud-Pulse Telemetry System for Enhanced MWD/LWD Applications", Copyright 2008, IADC/SPE Drilling Conference. Drilling conference held in Orlando, Florida, U.S.A. Mar. 4-6, 2008.

Pixton, David S., "Very High-Speed drill String Communications

Network", Report #41229R06, Topical Report,Testing at Rocky Mountain Oilfield Testing Center, Casper, WY, Feb. 3-10, 2003.
IADC 2004 Intelligent Drill Pipe Improves Drilling Efficiency, Enhances Well Safety and Provides Added Value. Michael J. Jellison, Grant Prideco; Robert Urbanowski, Grey Wolf Drilling Company L.P.; Hermann Sporker, OMV Aktiengesellschaft; Mike Reeves, Grant Prideco, 2004.
LWD and Telemetry Drill Pipe applications in Deep Water environments. Scott Stamper, Chevron; Maximo Hernandez, IntelliServ, 2007.
Jellison, Michael, J., et al., IADC 2005, "Advanced Drill Pipe With Streamline Enhances Slim-hole Drilling Performance", IADC World Drilling 2005 Conference & Exhibition held in Rome, Italy, Jun. 9-10, 2005.
"Very High-Speed Drill String Communications Network", Rocky Mountain E&P Technology Transfer Workshop, Aug. 4, 2003, Novatek.
Rogers, John D., PhD, P.E., et al., "Very High-Speed Drill String Communications Network: An Enabling Technology", Spring 2003, vol. 9, No. 2. Gas TIPS.
"Intelligent Pipe Technology Communicates Faster than Internet", May 27, 2006, TECHNEWS, located at http://www.technologynewsdaily.com/node/3101.
Reeves, Mike, et al., "Intellipipe moving closer to commercial reality", Mar./Apr. 2004, Drilling Contractor.
Fisher, Perry A., "Real real-time drill pipe telemetry: A step-change in drilling", vol. 224 No. 10, Oct. 2003, WordOil Magazine, located at http://findarticles.com/p/articles/mi_m3159/is_10_224/ai_n27663713/.
Chan, Alvaro, et al., IBP1446_06 Case Studies of Improved Drilling Performance Using High Performance 4 in. Drill Pipe and Streamlined Connection, Copyright 2006, Instituto Brazileiro de Petroleo e Gas—IBP, Rio Oil & Gas Expo and Conference 2006.
Jellison, Michael, J., et al., IADC 2002 "Next Generation Drill Pipe Extended Reach, Deepwater and Ultra-deep Drilling" 2002.
Alenkovich, G., et al. "Portable Locator for Underground Surveys", Advanced Automation Technologies Journal. #1, 1996.
Pomozov, V., et al., Advanced Automation Technologies Journal. #1, 1997.
Reshetnikov, P.M., "Well Survey Module Applications and Method for Data Processing while Directional and Horizontal Drilling with Downhole Telemetry Systems", Yekaterinburg, 2003.
Yakov A. Gelfgat et al. "Advanced Drilling Solutions, Lessons from the FSU.", vol. I, PennWell, USA, (2003).
Yakov A. Gelfgat et al. "Advanced Drilling Solutions, Lessons from the FSU", vol. II, PennWell, USA, (2003).

WIRED PIPE WITH WIRELESS JOINT TRANSCEIVER

BACKGROUND

As the sophistication and complexity of petroleum well drilling has increased, so has the demand for comparable increases in the amount of data that can be received from, and transmitted to, downhole drilling equipment. The demand for real-time data acquisition from measurement while drilling (MWD) and logging while drilling (LWD) equipment, as well as real-time precision control of directional drilling, have created a corresponding need for high bandwidth downhole systems to transfer such data between the downhole equipment and surface control and data acquisition systems.

There are currently a wide variety of downhole telemetry systems that are suitable for use in drilling operations. These include both wireless and wired systems, as well as combinations of the two. Existing wireless systems include acoustic telemetry systems, mud pulse telemetry systems, and electromagnetic telemetry systems. In acoustic telemetry systems, sound oscillations are transmitted through the mud (hydroacoustic oscillations), through the drill string (acoustic-mechanical oscillations), or through the surrounding rock (seismic oscillations). Such acoustic telemetry systems generally require large amounts of energy and are limited to data rates at or below 120 bits per second (bps). Mud pulse telemetry systems use positive and negative pressure pulses within the drilling fluid to transmit data. These systems require strict controls of the injected fluid purity, are generally limited to data rates of no more than 12 bps, and are not suitable for use with foam or aerated drilling fluids.

Electromagnetic telemetry systems include the transmission of electromagnetic signals through the drill string, as well as electromagnetic radiation of a signal through the drilling fluid. Transmission of electromagnetic signals through the drill string is generally limited to no more than 120 bps, has an operational range that may be limited by the geological properties of the surrounding strata, and is not suitable for use offshore or in salty deposits. Data transmission using electromagnetic radiation through the drilling fluid (e.g., using radio frequency (RF) signals or optical signals) generally requires the use of some form of a repeater network along the length of the drill string to compensate for the signal attenuation caused by the scattering and reflection of the transmitted signal. Such systems are frequently characterized by a low signal-to-noise ratio (SNR) at the receiver, and generally provide data rates comparable to those of mud pulse telemetry systems.

Existing wired systems include systems that incorporate a data cable located inside the drill string, and systems that integrate a data cable within each drill pipe segment and transmit the data across each pipe joint. Current wired systems have demonstrated data rates of up to 57,000 bps, and at least one manufacturer has announced a future system which it claims will be capable of data rates up to 1,000,000 bps. Wired systems with data cables running inside the drill string, which include both copper and fiber optic cables, generally require additional equipment and a more complex process for adding drill pipe segments to the drill string during drilling operations. Systems that integrate the cable into each drill pipe segment require pipe segments that are more expensive to manufacture, but generally such pipe segments require little or no modifications to the equipment used to connect drill pipe segments to each other during drilling operations.

As already noted, pipe segments with integrated data cables must somehow transmit data across the joint that connects two pipe segments. This may be done using either wired or wireless communications. Drill pipe segments that use wired connections generally require contacting surfaces between electrical conductors that are relatively free of foreign materials, which can be difficult and time consuming on a drilling rig. Also, a number of systems using drill pipes with integrated cables require at least some degree of alignment between pipe segments in order to establish a proper connection between the electrical conductors of each pipe segment. This increases the complexity of the procedures for connecting drill pipes, thus increasing the amount of time required to add each pipe segment during drilling operations.

Drill pipe segments with integrated cables that transmit data across the pipe joint wirelessly include systems that use magnetic field sensors, inductive coupling, and capacitive coupling. Systems that use magnetic field sensors, such as Hall Effect sensors, are generally limited to operating frequencies at or below 100 kHz. Systems that use inductive coupling currently are generally limited to data rates of no more than 57,000 bps. Systems using capacitive coupling require tight seals and tolerances in order to prevent drilling fluid from leaking into the gap between the pipe segments and disrupting communications. Based on the forgoing, existing downhole telemetry systems currently appear to be limited to proven data rates that are below 1,000,000 bps.

SUMMARY

A wireless transceiver for transmitting data across a drill pipe joint is described herein. At least some illustrative embodiments include a wireless communication apparatus that includes a housing configured to be positioned inside of, and proximate to an end of, a drill pipe used as part of a drill string. The housing includes an antenna configured such that at least one radio frequency (RF) signal propagation path is substantially parallel to the central axis of the housing, and an RF module coupled to the antenna and configured to couple to a communication cable (the RF module configured to provide at least part of a data re-transmission function between an RF signal present on the antenna and a data signal present on the communication cable). A radiotransparent material, which is transparent to RF signals within the operating frequency range of the RF module, is positioned along the circumference, and at or near an axial end, of the housing that is most proximate to the antenna. At least some axially propagated RF signals, which pass between the antenna and a region axially proximate to said axial end of the housing, pass through the radiotransparent material along the at least one RF signal propagation path.

At least some other illustrative embodiments include a wireless communication system that includes one or more RF transceivers (each transceiver housed within a housing that is configured to be positioned inside, and proximate to an end, of a drill pipe within a drill string, and each transceiver configured to be coupled by a communication cable to a downhole device positioned within the same drill pipe), one or more antennas (each antenna coupled to a corresponding RF transceiver of the one or more RF transceivers, and each antenna housed within the same housing as the corresponding RF transceiver), and one or more radiotransparent spacers that are transparent to RF signals within the operating frequency range of the one or more RF transceivers (each spacer positioned along the circumference, and at or near an axial end, of a corresponding housing that is most proximate to the antenna within the said corresponding housing). A first RF signal is received by first antenna of the one or more antennas through a first radiotransparent spacer of the one or more radiotransparent spacers, which is coupled to a first RF transceiver of the one or more transceivers that extracts receive data from the first RF signal and retransmits the receive data for inclusion in a first data signal transmitted to the downhole device over the data communication cable.

Other illustrative embodiments include a drill pipe used as part of a drill string that includes at least one housing (positioned inside of, and proximate to, one of two ends of the drill pipe), a communication cable that couples a radio frequency (RF) module to a downhole device within the drill pipe (the RF module providing at least part of a retransmission function between a data signal present on the communication cable and an RF signal present on an antenna) and at least one radiotransparent spacers (transparent to RF signals within the operating frequency range of the RF module, and positioned along the circumference of, and at or near an axial end of, the at least one housing, said axial end being an end most proximate to the antenna). The at least one housing includes the antenna (configured such that at least one RF signal propagation path is substantially parallel to the central axis of the drill pipe), and the RF module (coupled to the antenna and to the downhole device). At least some axially propagated RF signals, which pass between the antenna and a region axially proximate to the axial end of the corresponding housings, pass through the radiotransparent spacer along the at least one RF signal propagation path.

Still other illustrative embodiments include a drill string that includes a plurality of drill pipes, each drill pipe mechanically coupled to at least one other drill pipe to form the drill string. Each drill pipe includes at least one housing of a plurality of housings (positioned inside of, and proximate to, one of two ends of the drill pipe), a downhole device positioned inside the drill pipe, a communication cable that couples a radio frequency (RF) transceiver of the at least one housing to the downhole device (the RF transceiver providing at least part of a retransmission function between a data signal present on the communication cable and an RF signal present on an antenna), and at least one radiotransparent spacer (transparent to RF signals within the operating frequency range of the RF transceiver, and positioned along the circumference of, and at or near an axial end of, the at least one housing, said axial end being an end most proximate to the antenna). The at least one housing includes the antenna (configured such that at least one RF signal propagation path is substantially parallel to the central axis of the drill pipe), and the RF transceiver (coupled to the antenna). A first end of a first drill pipe is mechanically coupled to a second end of a second drill pipe, a first housing of the at least one housing of the first drill pipe positioned within the first end, and the at least one housing of the second drill pipe positioned within the second end. At least some axially propagated RF signals that pass between the antennas of the first and second drill pipes also pass through the radiotransparent spacers of both the first and second drill pipes along the at least one RF signal propagation path.

Yet other illustrative embodiments include a method for wireless transmission of data across a joint mechanically connecting two drill pipes within a drill string, which includes receiving (by a radio frequency (RF) transmitter at or near a first end of a first drill pipe) data across a cable from a first device within the first drill pipe; the RF transmitter modulating an RF signal using the data received, and the RF transmitter transmitting the modulated RF signal using a first antenna (through a first radiotransparent material, and across the joint mechanically connecting the first drill pipe to a second drill pipe). The method further includes propagating the RF signal along an RF signal propagation path substantially parallel to the central access of at least one of the two drill pipes, receiving (by an RF receiver using a second antenna at or near a second end of a second drill pipe) the modulated RF signal through a second radiotransparent material (the first and second radiotransparent material both positioned in a space within the joint between the first antenna and the second antenna), the RF receiver extracting the data from the modulated RF signal, and the RF receiver transmitting the data across a cable to a second device within the second drill pipe.

BRIEF DESCRIPTION OF THE DRAWINGS

For a detailed description of at least some illustrative embodiments, reference will now be made to the accompanying drawings in which.

DETAILED DESCRIPTION

Figure 1:
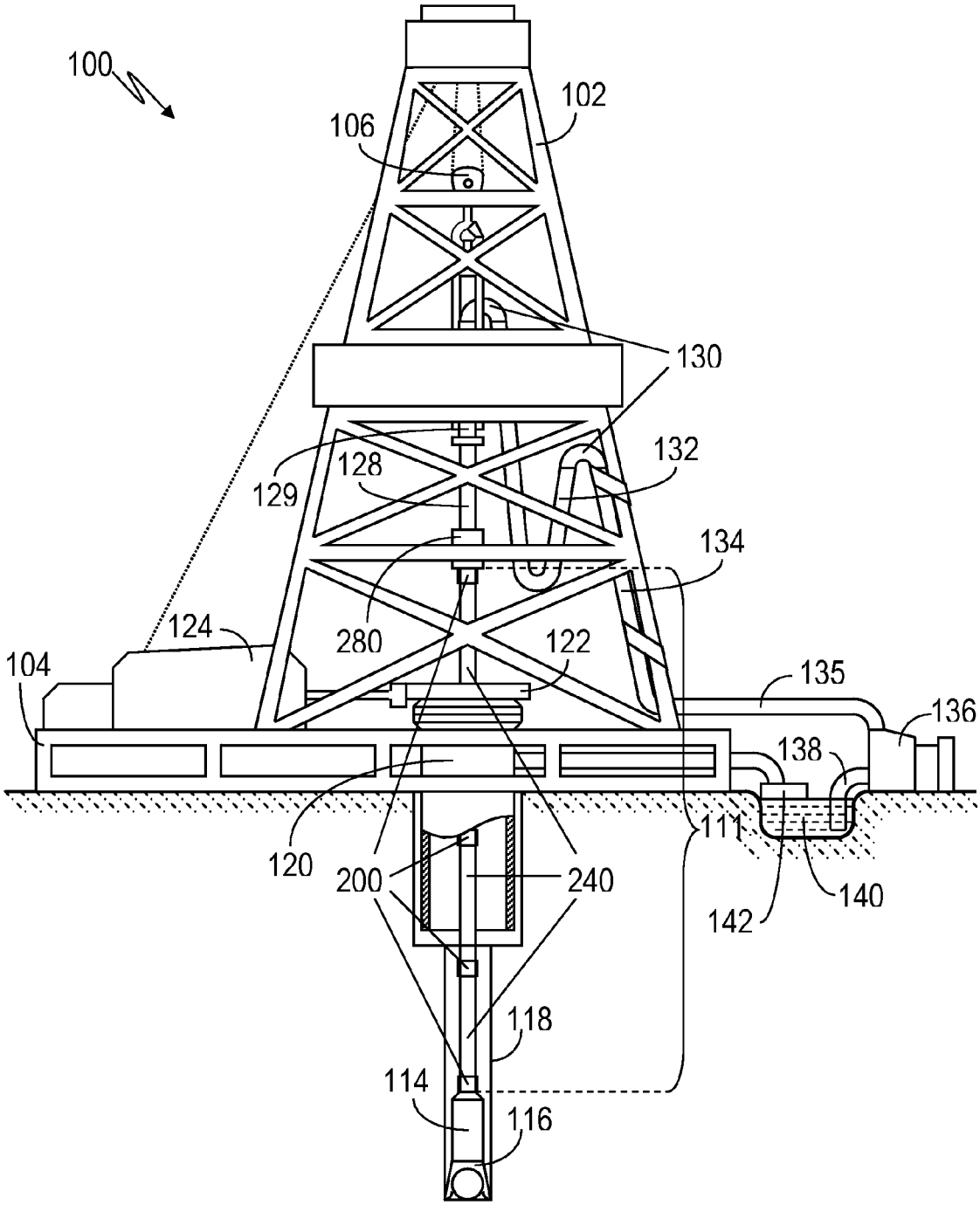
FIG. 1 shows a petroleum drilling well in which a communication apparatus and system constructed in accordance with at least some illustrative embodiments is employed.

FIG. 1 shows a petroleum drilling rig 100 that incorporates drill pipes, pipe joints, wireless joint transceivers, and a communication system, each in accordance with at least some illustrative embodiments. A derrick 102 is supported by a drill floor 104, and drilling of the petroleum well is performed by a continuous drill string 111 of drill pipes 240. The drill pipes 240 are mechanically connected to each other by joints 200, which each incorporates a wireless transceiver and power unit (TPU) (not shown) for transmitting and receiving data across the joint. The drill pipes 240, joints 200 and TPUs are all constructed in accordance with at least some illustrative embodiments, some of which are described in more detailed below. A travelling block 106 supports a Kelly 128 at the end of a swivel 129. Kelly 128 connects to the end of drill string 111, enabling travelling block 106 to raise and lower drill string 111 during drilling operations. In the illustrative embodiment shown, communications relay transceiver 280 attaches to Kelly 128 at a point proximate to the TPU at the upper end of drill string 111, and acts as a wireless communication relay between the wireless communication system incorporated within drill string 111 and the computer systems (not shown and also wirelessly communicating with relay 280) used to control and monitor drilling operations.

Drill string 111 is raised and lowered through rotary table 122, which is driven by Motor 124 to rotate drill string 111 and drill bit 116 (connected at the end of drill string 111 together with bottom hole assembly (BHA) 114). Rotary table 122 provides at least some of the rotary motion necessary for drilling. In other illustrative embodiments, swivel 129 is replaced by a top drive (not shown), which rotates drill string 111 instead of rotary table 122. Additional rotation of drill bit 116 and/or of the cutting heads of the drill bit may also be provided by a downhole motor (not shown) within or close to drill bit 116. Drilling fluid or "mud" is pumped by mud pump 136 through supply pipe 135, stand pipe 134, Kelly pipe 132 and goose necks 130 through swivel 129 and Kelly 128 into drill string 111 at high pressure and volume. The mud exits out through drill bit 116 at the bottom of wellbore 118, travelling back up wellbore 118 in the space between the wellbore wall and drill string 111, and carrying the cuttings produced by drilling away from the bottom of wellbore 118. The mud flows through blowout preventer (BOP) 120 and into mud pit 140, which is adjacent to derrick 102 on the surface. The mud is filtered through shale shakers 142, and reused by mud pump 136 through intake pipe 138.

Figure 2:
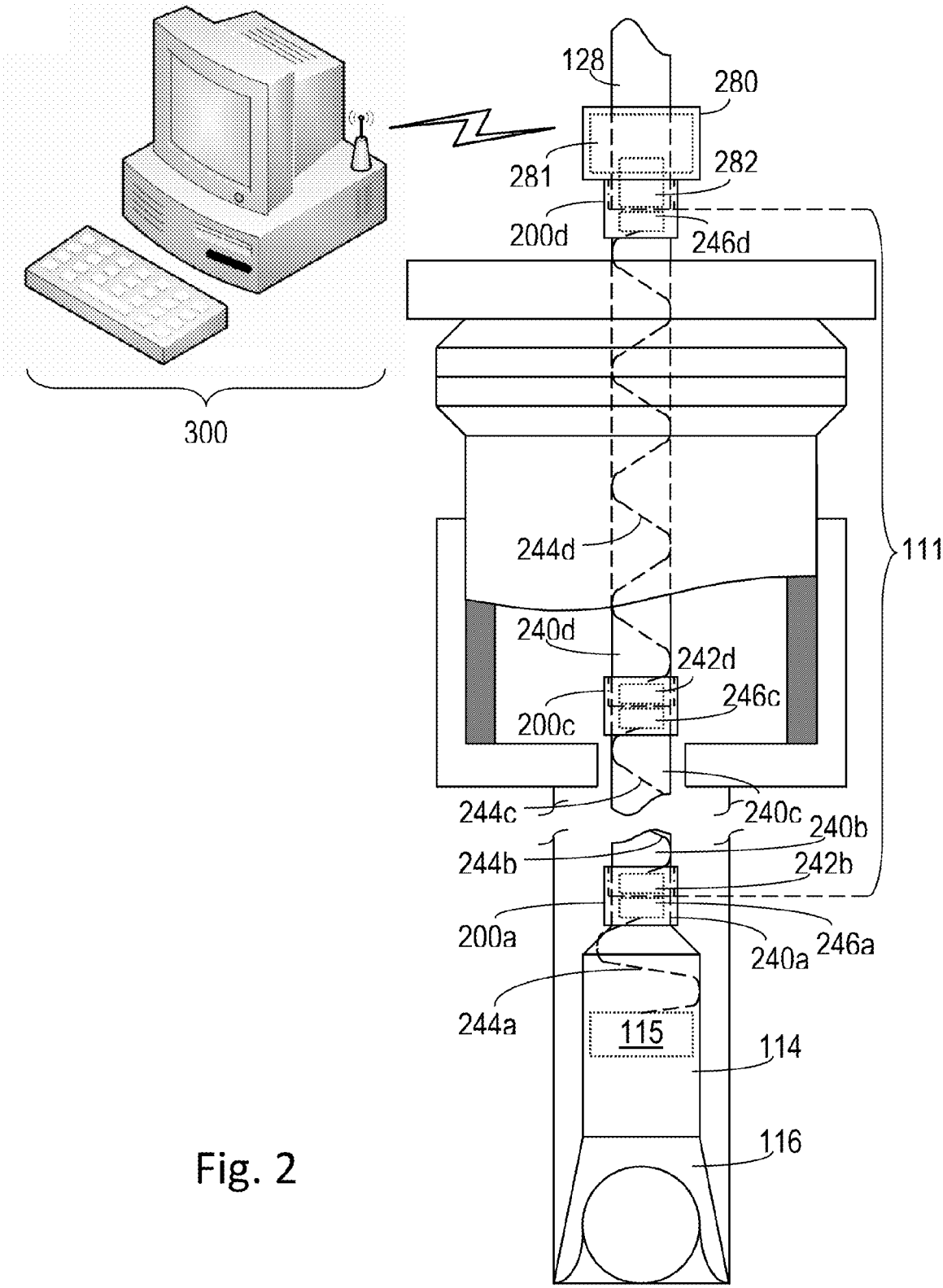
FIG. 2 shows the drill string of FIG. 1, incorporating wireless communication assemblies within a communication system constructed in accordance with at least some illustrative embodiments.

As already noted, drill string 111 incorporates a communication system constructed in accordance with at least some illustrative embodiments. Such a communication system, an example of which is shown in FIG. 2, enables data communication between surface equipment (e.g., computer system 300) and downhole equipment (e.g., downhole device 115). Continuing to refer to FIG. 2, each drill pipe 240 (which for purposes of this disclosure includes the outer housing 240*a* of BHA 114) includes a TPU 246 at one end of the drill pipe, which is coupled to a second downhole device by a cable 244. In the example of FIG. 2, drill pipes 240*d*, 240*c* and 240*b* each respectively include a TPU 246*d*, 246*c* and 246*b* (not shown), which each respectively couples via data cable 244*d*, 244*c* and 244*b* to TPUs (i.e., the downhole devices) 242*d*, 242*c* (not shown) and 242*b*. For BHA 114, TPU 240*a* couples via cable 244*a* to downhole device 115. Downhole device 115 may include an MWD device, an LWD device or drill bit steering control logic, just to name a few examples.

Data cables 244 can include either copper wire to transmit electrical signals, or optical fiber to transmit optical signals. Data cables 244 allow information to be exchanged between the devices (e.g., TPUs) within the drill pipes 240. In the example of FIG. 2 the cables are armored cables that are attached to the inner wall of each corresponding drill pipe in a coiled pattern that allows for a certain amount of flexing of the drill pipes. The data cables may be attached to the inner surface of the drill pipes, or routed through channels cut into the inner surface of the drill pipes. Many techniques for securing, attaching and routing cables along and within drill pipes are known to those of ordinary skill in the art, and such techniques will thus not be discussed any further. All such techniques are within the scope of the present disclosure.

Continuing to refer to FIG. 2 and using an LWD device as an example of a downhole device 115, logging data is generated by LWD device 115 during drilling operations. The data is formatted and transmitted by LWD device 115 along data cable 244*a* to TPU 246*a* within pipe joint 240*a*. In the illustrative embodiment of FIG. 2, the pipe joints 240 of drill string 111 are pin and box type joints, used to mechanically connect adjacent drill pipes within drill string 111. BHA 114 includes the box portion of joint 240*a* that incorporates TPU 246*a*, and drill pipe 240*b* includes the pin portion of joint 240*a* that incorporates TPU 242*b*. TPU 246*a* receives the data transmitted over data cable 244*a* by LWD device 115 and wirelessly transmits the data to TPU 242*b*. TPU 242*b* in turn receives the wireless transmission from TPU 246*a* and reformats and transmits the received data along data cable 244*b* to TPU 246*b* (not shown) at the other end of drill pipe 240*b*. The retransmission of data is repeated along each data cable and wirelessly at each TPU pair (e.g., along data cable 244*c* within drill pipe 240*c* to TPU 246*c*, wirelessly from TPU 246*c* to TPU 242*d*, and along data cable 244*d* within drill pipe 240*d* to TPU 246*d*).

Once the data reaches the TPU at the top of drill string 111 (e.g., TPU 246*d* of FIG. 2), the data is wirelessly transmitted to drill string repeater 282 (part of communications relay transceiver 280), which couples to external equipment repeater 281 (also part of communications relay transceiver 280) through Kelly 128 (e.g., via sealed, high pressure CONex type connectors). External equipment repeater 281 in turn retransmits the logging data to computer system 300 (e.g., a personal computer (PC) or other computer workstation) for further processing, analysis and storage. In the example of FIG. 2 external equipment repeater 281 communicates with computer system 300 wirelessly, but wired communication is also contemplated. Many such communications systems for exchanging data between surface equipment and drill string communication systems (both wired and wireless) are known within the art, and all such communications systems are within the scope of the present disclosure.

In other illustrative embodiments, downhole device 115 includes drill bit direction control logic for controlling the direction of drill bit 116. Control data flows in the opposite direction from computer system 300, through communications relay transceiver 280 to TPU 246*d*, across data cable 244*d* to TPU 242*d*, and wirelessly to TPU 246*c* and across cable 244*c*. The data is eventually transmitted across cable 244*b* to TPU 242*b*, wirelessly to TPU 246*a*, and across data cable 244*a* to the direction control logic of downhole device 115, thus providing control data for directional control of drill bit 116.

Figure 3:
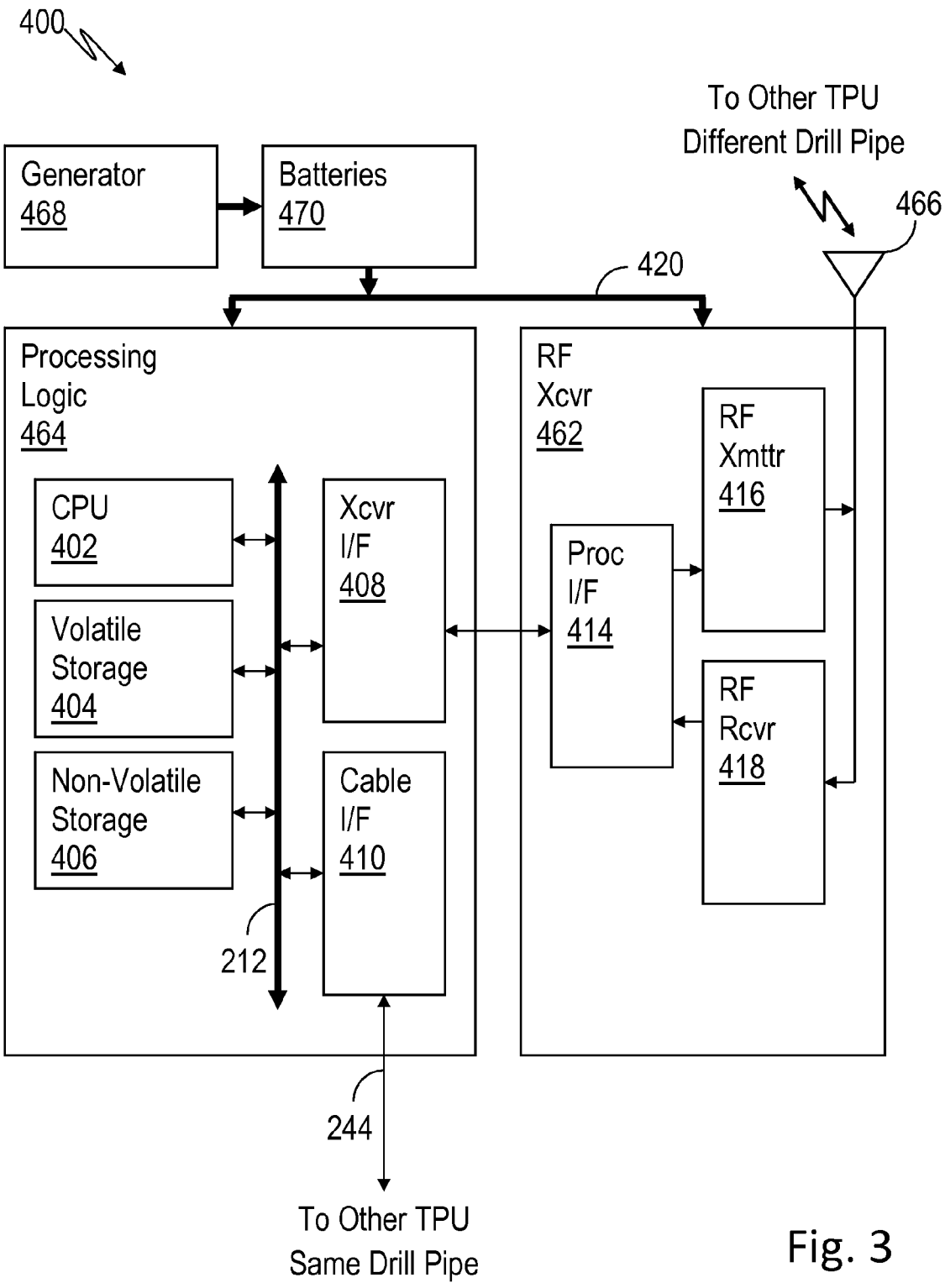
FIG. 3 shows a block diagram of a wireless communication assembly constructed in accordance with at least some illustrative embodiments.

FIG. 3 shows a block diagram of a TPU 400, suitable for use as TPUs 242 and 246 of FIG. 2, in accordance with at least some illustrative embodiments. TPU 400 includes radio frequency transceiver (RF Xcvr) 462, which includes RF transmitter (RF Xmttr) 416, RF receiver (RF Rcvr) 418 and processor interface (Proc I/F) 414. The output from RF transmitter 416 and the input to RF receiver 418 both couple to antenna 466, which transmits RF signals generated by RF transmitter 416 (and sent to other TPUs), and receives RF signals processed by RF receiver 418 (received from other TPUs). Processor interface 414 couples to both RF transmitter 416 and RF receiver 418, providing data received from processing logic 464 to modulate the RF signal generated by RF transmitter 416, and forwarding data to processing logic 464 that is extracted from the received RF signal by RF receiver 418. In this manner, RF transceiver 462 implements at least part of a data retransmission function between the RF signal present on antenna 466 and a data signal present on data cable 244 (described further below). In at least some illustrative embodiments, the interface between processor interface 414 and transceiver interface (Xcvr I/F) 408 of processing logic 464 is an RS-232 interface. Those of ordinary skill in the art will recognize that other interfaces may be suitable for use as the interface between RF transceiver 462 and processing logic 464, and all such interfaces are within the scope of the present disclosure.

TPU 400 further includes processing logic 464, which in at least some illustrative embodiments includes central processing unit (CPU) 402, volatile storage 404 (e.g., random access memory or RAM), non-volatile storage 406 (e.g., electrically erasable programmable read-only memory or EEPROM), transceiver interface 408 and cable interface (Cable I/F) 410, all of which couple to each other via a common bus 212. CPU 402 executes programs stored in non-volatile storage 406, using volatile storage 404 for storage and retrieval of variables used by the executed programs. These programs implement at least some of the functionality of TPU 400, including decoding and extracting data encoded on a data signal present on data cable 244 (coupled to cable interface 410) and forwarding the data to RF transceiver 462 via transceiver interface 408, as well as forwarding and encoding data received from RF transceiver 462 onto a data signal present on data cable 244. In this manner, processing logic 464, in at least some illustrative embodiments also implements at least part of a data retransmission function between an RF signal present on antenna 466 and a data signal present on data cable 244.

TPU 400 also includes power source 468, which couples to batteries 470. Batteries 470 provide power to both processing logic 464 and RF transceiver 462, while power source 468 converts kinetic energy (e.g., oscillations of the drill string or the flow of drilling fluid) into electrical energy, or thermal energy (e.g., the thermal difference or gradient between different regions inside and outside the drill string) into electrical energy, which is used to charge batteries 470. Other techniques for producing electrical energy, such as by chemical or electrochemical cells, will become apparent to those of ordinary skill in the art, and all such techniques are within the scope of the present disclosure. In other illustrative embodiments (not shown), electrical energy can be provided from the surface and transferred to the TPUs using wireless energy transfer technologies such as WiTricity and wireless resonant energy link (WREL), just to name a few examples.

Figure 4A:
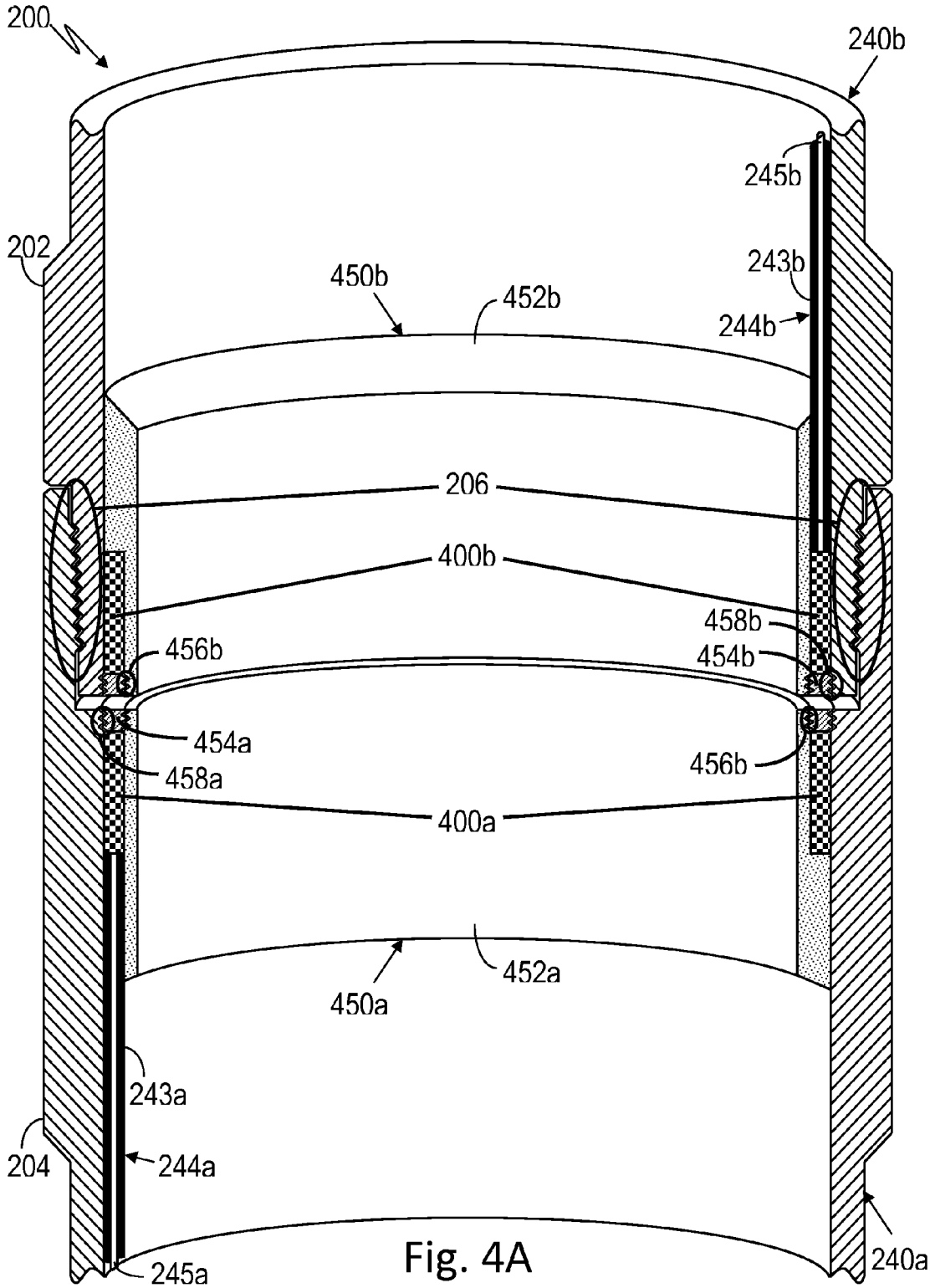
FIG. 4A shows a detailed cross-sectional diagram of a drill pipe joint incorporating a wireless communication assembly constructed in accordance with at least some illustrative embodiments, which includes a radiotransparent spacer separate from and attached to the annular housing.

FIG. 4A shows a drill pipe joint 200 joining two drill pipes using a pin and box configuration, each drill pipe joint section including a wireless communication assembly constructed in accordance with at least some illustrative embodiments. Pin 202 of drill pipe 240*b* includes wireless communication assembly 450*b*, and attaches to box 204 of drill pipe 240*a* via threads 206. Box 204 similarly includes wireless assembly 450*a*. Each wireless communication assembly 450(*a* and *b*) includes a radiotransparent housing 452, a TPU 400 and a radiotransparent spacer 454. Each TPU 400 couples to a corresponding data cable 244, which includes one or more conductors 245 that are protected by external cable armor 243, and which attaches to the drill pipe's inner wall as previously described. Alternatively, one or more optical fibers 245, or combinations of electrical conductors and optical fibers 245, may be used, and all such data transmission media and combinations are within the scope of the present disclosure.

The radiotransparent material used in both the spacers and housings results in little or no attenuation of radio frequency signals transmitted and received by the TPUs as the signals pass through the spacer and housing, as compared to the attenuation of the RF signal that results as it passes through the metal body of the drill pipe and through the drilling fluid flowing within the drill pipe. In the example of FIG. 4A, each radiotransparent spacer 454 attaches to its corresponding radiotransparent annular housing 452 via an inner thread 456. Each radiotransparent spacer 454 further includes an outer thread 458, which mates with a corresponding thread along the inner wall of each of pin 202 and box 204. Thus housing 452*a* attaches to spacer 454*a* via threads 456*a*, which in turn mates with box 204 via threads 458*a*, securing the spacer and housing to the upper end of drill pipe 240*a*. Housing 452*b* and spacer 454*b* are similarly secured (via threads 456*b* and 458*b*), to pin 202 at the lower end of drill pipe 240*b*. Although the radiotransparent spacers and the housings are described and illustrated as attached to the drill pipe using threads, those of ordinary skill in the art will recognize that other techniques and/or hardware may be used to attach these components. For example, screws, press fittings and C-rings could be used, and all such techniques and hardware are contemplated by the present disclosure. Those of ordinary skill in the art will also recognize that although an annular housing is used in the embodiments presented herein, other geometric shapes may be suitable in forming the housing, and all such geometries are also contemplated by the present disclosure.

Figure 4B:
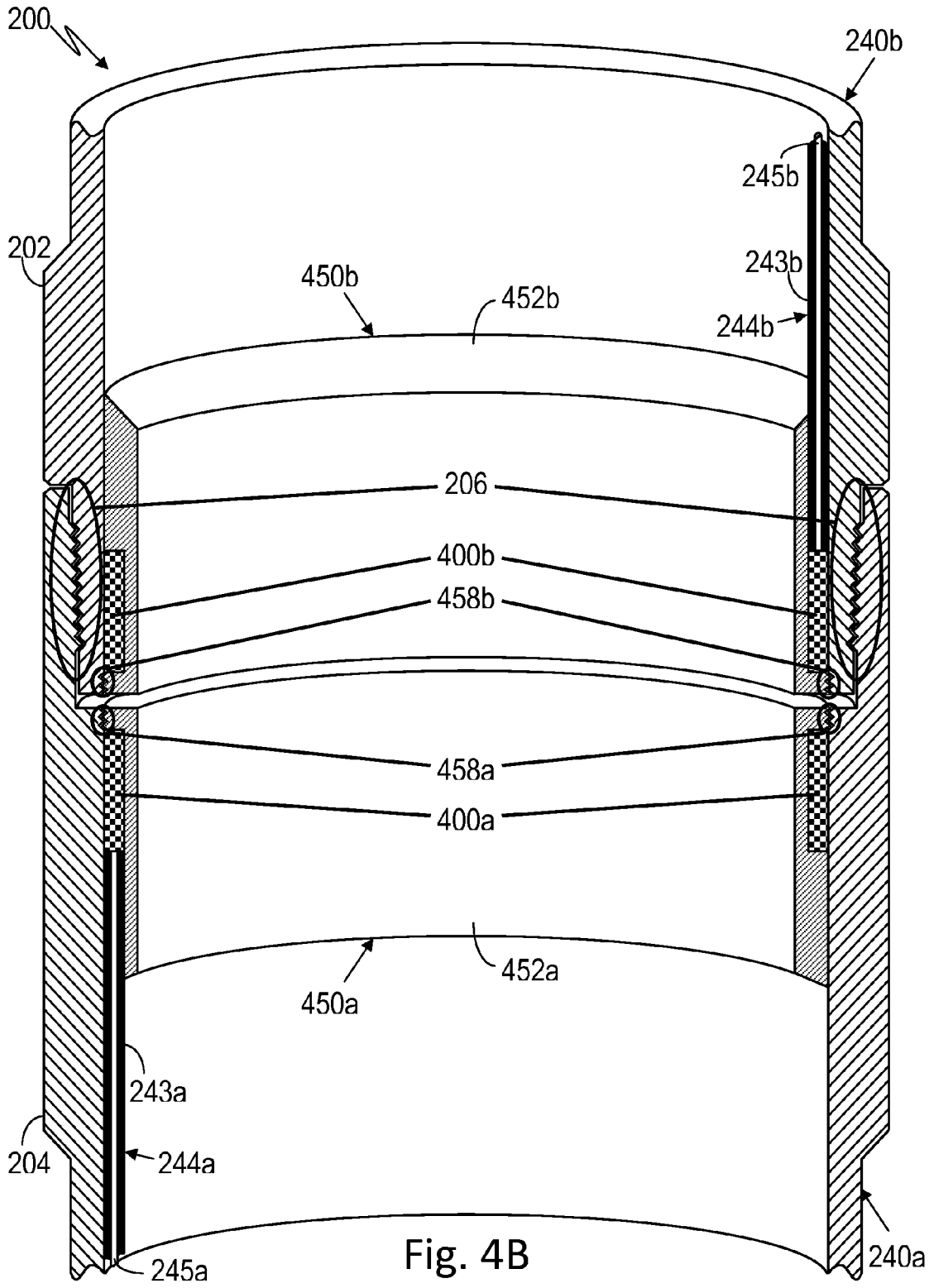
FIG. 4B shows a detailed cross-sectional diagram of a drill pipe joint incorporating a wireless communication assembly constructed in accordance with at least some illustrative embodiments, which includes an annular housing made entirely of a radiotransparent material.

Each spacer, together with its corresponding housing, operates to protect and isolate its corresponding TPU from the environment within the drill pipe, and provides a path for RF signals to be exchanged between the TPUs with little or no attenuation of said RF signals. Although the gap between the ends of the two wireless communication assemblies 450*a* and 450*b* (i.e., between the spacers and housings of each of the two drill pipes, shown exaggerated in the figures for clarity), and/or the gap between each spacer and the housing, may allow drilling fluid into the path of the RF signal, the level of attenuation of the RF signal that results can be maintained within acceptable limits for a given transmission power at least by limiting the size of the gaps. In at least some illustrative embodiments, such as shown in the example of FIG. 4B, at least some of the gaps (e.g., between the spacer and the housing) are eliminated through the use of a single piece radiotransparent housing that does not require a separate spacer. In other illustrative embodiments, the level of attenuation of the RF signals in the gap between the ends of wireless communication assemblies 450*a* and 450*b* may be reduced through the use of additional radiotransparent spacers (made of either rigid or flexible materials) positioned within the gap (not shown).

Figure 5:
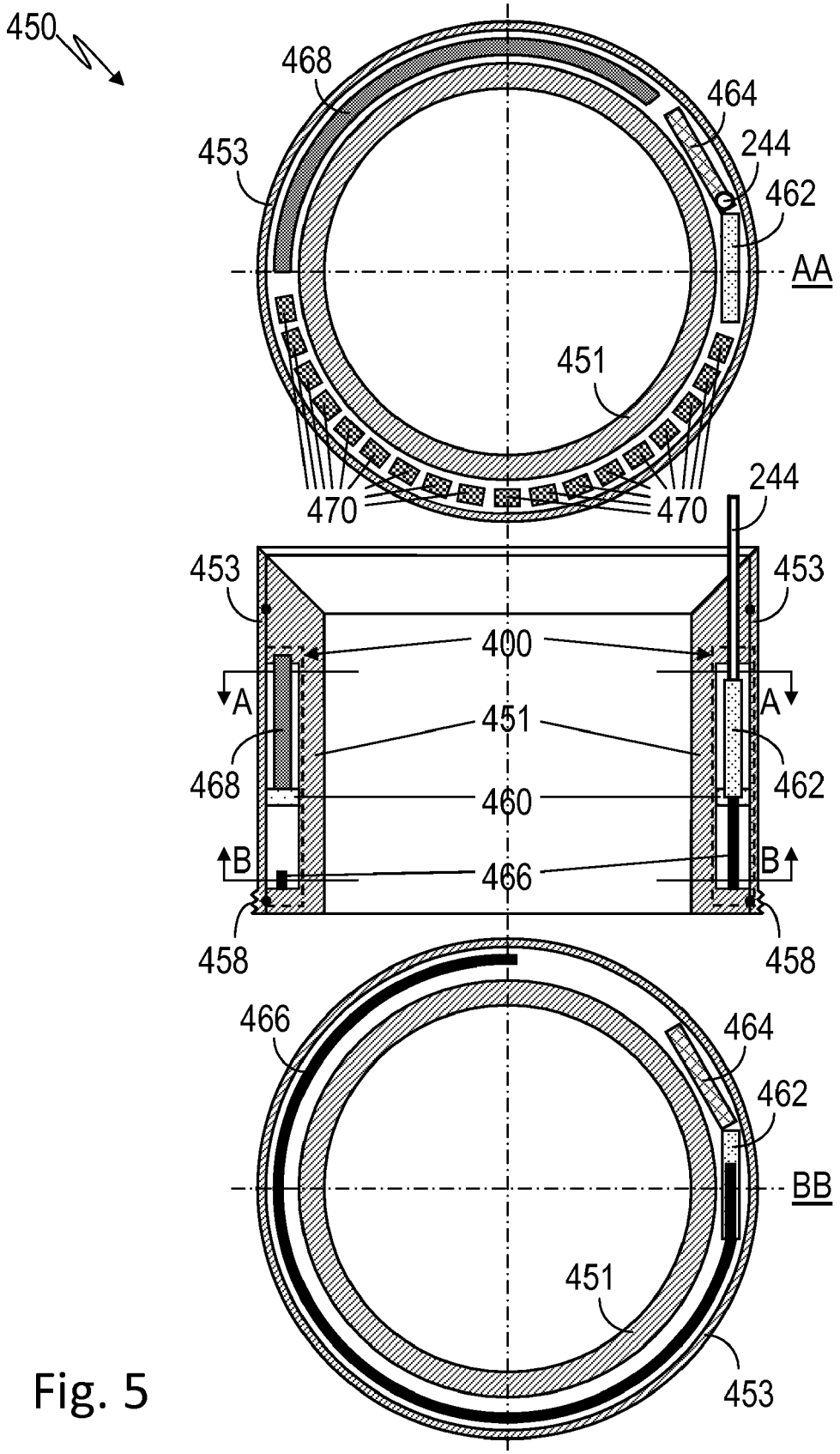
FIG. 5 shows detailed cross-sectional views of the wireless communication assembly of FIG. 4B, constructed in accordance with at least some illustrative embodiments.

FIG. 5 shows detailed cross-sectional views of a wireless communication assembly 450, constructed in accordance with at least some illustrative embodiments. A lateral cross-sectional view is shown in the center of the figure, a top cross-sectional view AA is shown at the top of the figure as seen from the end of the assembly extending into the drill pipe (see FIG. 4B), and a bottom cross-sectional view BB is shown at the bottom of the figure as seen from the end of the assembly closest to the open end of the drill pipe (see FIG. 4B). Continuing to refer to FIG. 5, wireless communication assembly 450 includes annular housing body 451 and annular housing cover 453, which together to form radiotransparent annular housing 452 of FIG. 4B. Annular housing cover 453 includes one side of threads 158 of FIG. 4B, used to attach assembly 450 to the drill pipe. Annular housing cover 453 covers and seals various cavities within annular housing 453 that house the various components of wireless communication assembly 450. These components together form TPU 400, and include wireless transceiver 462, processing logic 464 (coupled to both wireless transceiver 462 and data cable 244), antenna 466 (coupled to wireless transceiver 462), batteries 470 (coupled to each other, and to both wireless transceiver 462 and processing logic 464 to which they provide power), and power source 468 (e.g., a generator or a wireless energy transfer power source), which provides power to recharge batteries 470.

In at least some illustrative embodiments, power source 468 is a kinetic microgenerator that converts drill string motion and oscillations into electrical energy. In other illustrative embodiments, power source 468 is a kinetic microgenerator that converts movement of the drilling fluid into electrical energy. In yet other illustrative embodiments, power source 468 is a thermal microgenerator that converts thermal energy (i.e., thermal gradients or differences within and around the drill string) into electrical energy. Many other systems for providing electrical energy for recharging the batteries and providing power to wireless communication assembly 450 will become apparent to those of ordinary skill in the art, and all such systems are within the scope of the present disclosure.

Figure 6:
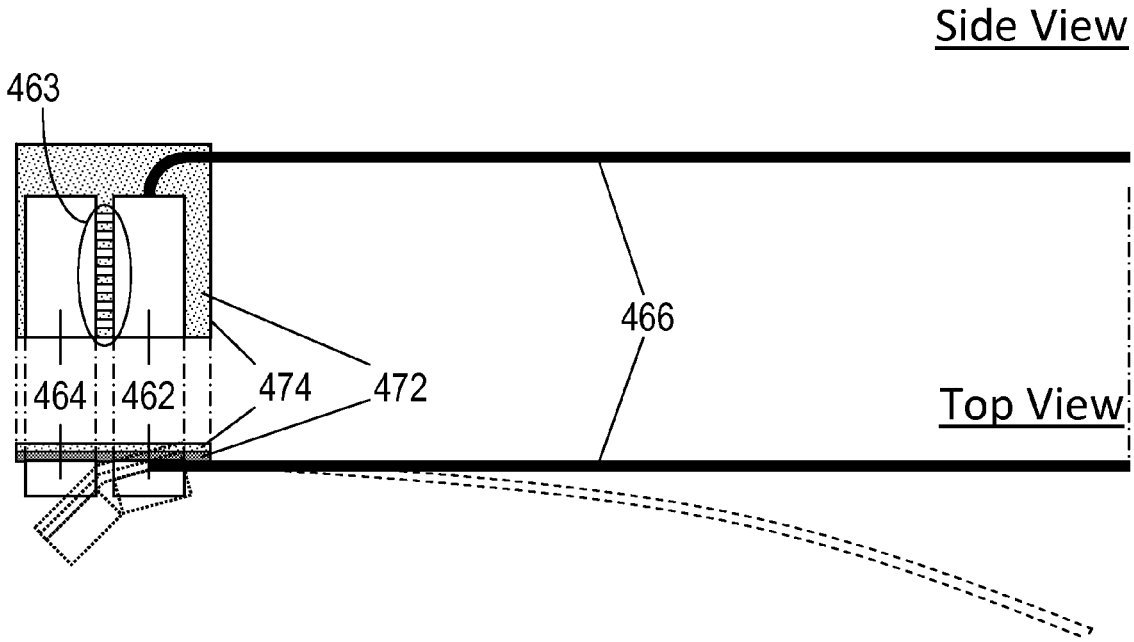
FIG. 6 shows a side and top view of a transceiver and antenna assembly used within the wireless communication assembly of FIG. 5, constructed in accordance with at least some illustrative embodiments.

As can be seen in the illustrative embodiment of FIG. 5, components are positioned in voids provided within annular housing body 451. The voids are of sufficient depth so as to allow small rectangular components (such as wireless transceiver 462, processing logic 464 and each of the batteries 470) to be positioned within annular housing body 451 without mechanically interfering with annular housing cover 453. Other larger components, such as antenna 466 and power source 468, are shaped to conform to the curve of annular housing body 451. FIG. 6 shows an example of how antenna 466 may be mounted to conform to such a curve, in accordance with at least some illustrative embodiments. Antenna 466 is an example of a 2.450 GHz, spike antenna designed to be used together with a wireless communication assembly mounted within a 5½" full hole (FH) drill pipe joint. The use of 2.450 GHz as the center frequency of the RF transceivers allows wireless transceiver 462 to be chosen from a broad selection of small, low-power, inexpensive and readily available transceivers (e.g., the RC2000/RC2100 series RF modules manufactured by Radiocrafts) that are designed with an operating frequency range within the industrial, scientific and medical (ISM) band defined between 2.400 GHz and 2.500 GHz. This broad selection of transceivers is due, at least in part, to the extensive use of this band in a large variety of applications and under a number of different communication standards (e.g., Wi-Fi, Bluetooth and ZigBee). The use of this frequency further allows for higher data rates than current systems, easily accommodating data rates in excess of 1,000,000 bps. The use of this frequency also allows for the use of any type of antenna suitable for use within the ISM band (e.g., spike antennas and loop antennas) within the limited amount of space of annular housing body 451, due to the relatively small wavelength of the RF signal (and the corresponding small dimensions of the antenna). Nonetheless, those of ordinary skill will recognize that other components operating at other different frequencies may be suitable for use in implementing the systems, devices and methods described and claimed herein, and all such components and frequencies are within the scope of the present disclosure.

Continuing to refer to FIG. 6, antenna 466 couples to wireless transceiver 462, which is mounted on one side of a flexible dielectric substrate 472 manufactured of Polytetrafluoroethylene (PTFE, sometimes referred to as Teflon®) that is radiotransparent to RF signals in the 2.400-2.500 GHz range. Antenna 466 is made of a flexible material as well, allowing it to conform to the curvature of annular housing body 451, as shown by the dashed outline of the right end of substrate 472 in FIG. 6. Processing logic 464 is also mounted on substrate 472 and coupled to wireless transceiver 462 via interconnect 463. A shield plate 474 is mounted on the side of the substrate opposite wireless transceiver 462 and processing logic 464. In at least some illustrative embodiments, the shield plate is a thin flexible conductor that, together with the flexibility of substrate 472, allows wireless transceiver 462 and processing logic 464 to be positioned as shown in FIG. 5, conforming to the curvature of annular housing body 451. In other illustrative embodiments, the shield plate is more rigid and has fixed bends (as shown in FIG. 6 by the dotted outline of the left end of substrate 472) to also allow the positioning of the components as shown in FIG. 5.

As previously noted, transmitted RF signals suffer significant attenuation when passing through the metal drill pipe and through the drilling fluid within the drill pipe. This is due to the fact that when an RF signal passes through a material, the higher its conductivity (or the lower its resistivity), the higher the amount of energy that is transferred to the material, resulting in a corresponding decrease or attenuation in the magnitude of the RF signals that reach the RF receiver. Thus, the attenuation of the RF signal that reaches a receiver can be minimized by reducing the amount of RF energy that is propagated through materials with high conductivity. Such a reduction can be achieved or offset by: 1) reducing the distance that the signal traverses between the transmitter and the receiver; 2) using antennas at the transmitter, receiver, or both that provide additional gain to the transmitted and/or received signals; and 3) using antenna configurations and geometries that result in radiation patterns that focus as much of the propagated RF signal as possible through materials positioned between the transmitter and receiver that are transparent (i.e., have a very low conductivity, or are non-conducting and have a low dielectric dissipation factor) within the frequency range of the propagated RF signals. For example, some high temperature fiberglass plastics (i.e., fiber-reinforced polymers or glass-reinforced plastic), with working temperatures of 572° F.-932° F. and dielectric dissipation factors of 0.003-0.020, are suitable for use with at least some of the illustrative embodiments, as are some silicon rubbers with comparable dielectric properties.

Figure 7:
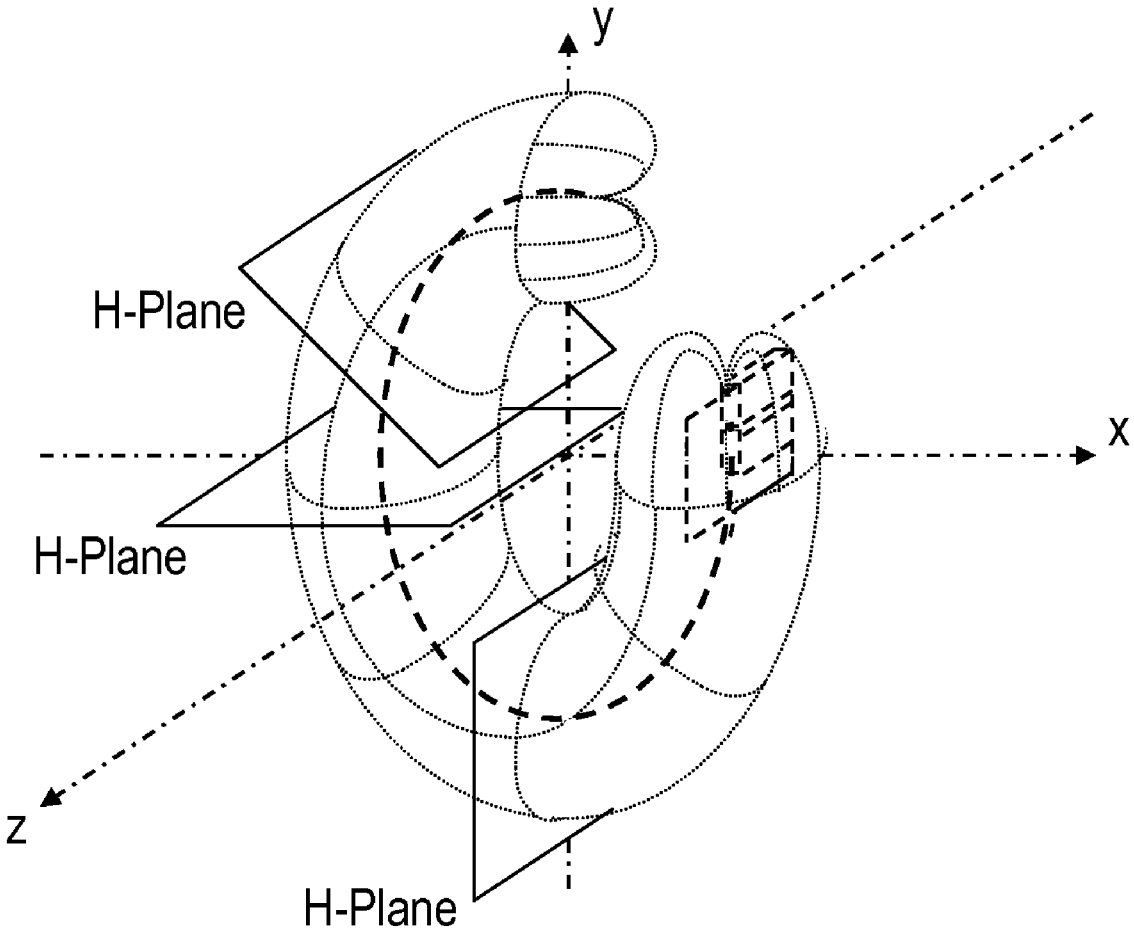
FIG. 7 shows an example of an antenna gain pattern suitable for use with at least some illustrative embodiments.

The use of wireless data transmission at the pipe joints and wired data transmission within a drill pipe, as previously described and shown in FIG. 2, reduces the transmission distance to that of the distance between the TPUs described and shown in FIGS. 4A and 4B, or more specifically between the antennas of the TPUs, shown and described in FIGS. 4A, 4B and 5. Multi-element antennas (not shown) may be used in at least some embodiments to increase the gain at the transmitting and/or receiving antennas. FIG. 7 shows an example of a radiation pattern that focuses the radiated energy within the radiotransparent material. The "doughnut" shaped radiation pattern results in at least part of the region of maximum intensity of the radiated signal being propagated along the z-axis within the annular region between two adjacent antennas (e.g., the region between TPUs 400*a* and 400*b* of FIG. 4A, including radiotransparent spacers 454*a* and 454*b*, as well as the gap between the spacers). As can be seen in FIG. 7, radiation patterns that maximize the radiated energy propagated through the radiotransparent material include patterns wherein the plane containing the magnetic field vector (or "H-plane") is parallel to the z-axis (corresponding to the central axis of annular housings 452*a* and 452*b* of FIG. 4B), and thus parallel to the propagation path of the RF signal.

By focusing the beam along a path between the two antennas that is filled primarily or entirely with a radiotransparent material, the RF signal transmitted along the signal propagation path between the two TPU antennas is received with little or no attenuation by the receiving TPU. Also, by curving the antenna into a loop as shown in FIG. 7, the transmitting and receiving antennas are substantially insensitive to differences in their relative angular or radial orientations (compared to other antennas such as, e.g., straight dipole antennas), due to the general uniformity of the RF radiation pattern illustrated in the figure. As a result, the magnitude of the signal present at the receiving TPU is substantially independent of the relative radial orientations of the transmitting and receiving TPU antennas. This orientation insensitivity, coupled with the wireless communication link used between TPUs, allows drilling pipes to be connected to each other during drilling operations without any additional or special procedures or equipment, relative to those currently in operation.

Additionally, by improving the magnitude of the RF signal present at the receiving TPU, less power is needed (compared to at least some other existing downhole communication systems) both to transmit the RF signal and to amplify and process the received RF signal, for a given desired signal to noise ratio at the receiving TPU. This lower power consumption rate allows the TPU to operate for a longer period of time without having to shut down and allow the power source to recharge the batteries. In systems that do not incorporate a power source, the TPU can operate for a longer period of time without having to trip the drill string in order to charge or replace the TPU batteries (or replace a pipe segment with dead TPU batteries). Also, by improving the power efficiency of the system, higher data rates may be achieved (within the bandwidth limits of the system) for a given level of power consumption relative to existing systems (based on the premise that the higher operating frequencies needed for higher data transmission rates incur higher TPU power consumption).

Figure 8:
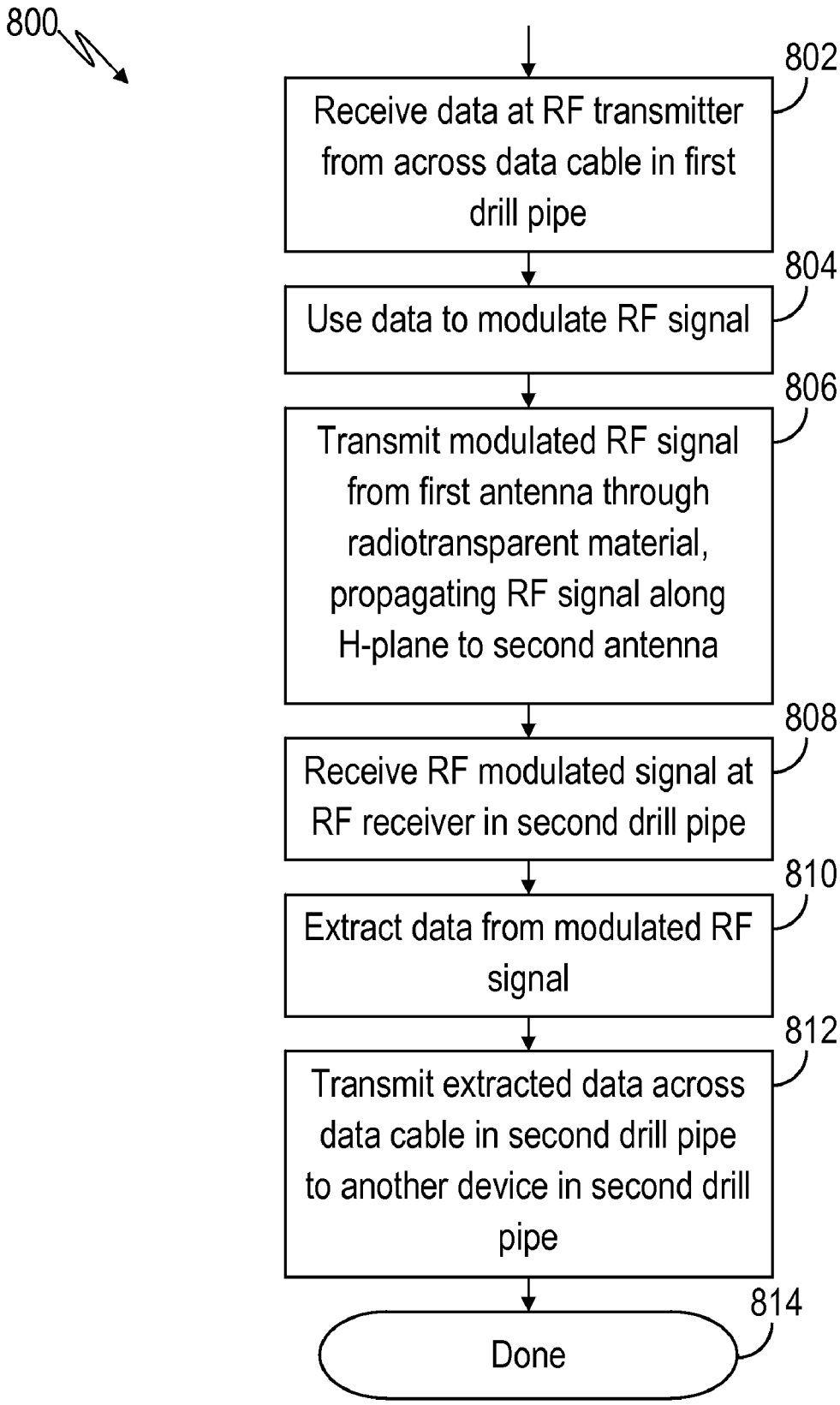
FIG. 8 shows a method for wireless transmission of data across a joint mechanically connecting two drill pipes within a drill string, in accordance with at least some illustrative embodiments.

FIG. 8 shows a method 800 for wireless transmission of data across a joint mechanically connecting two drill pipes within a drill string used for drilling operations, in accordance with at least some illustrative embodiments. Data is received across a data cable in a first drill pipe by an RF transmitter in the same drill pipe (block 802). The received data is used to modulate an RF signal (block 804), which is transmitted from a first antenna within the first drill pipe through radiotransparent material, propagating the RF signal to a second antenna within a second drill pipe along a path that is parallel to an H-plane associated with at least part of one or both of the two antennas (block 806). In at least some illustrative embodiments, the RF signal is further transmitted across one or more gaps in the radiotransparent material, which contains drilling fluid that is made to circulate through the drill string (not shown). The modulated RF signal present at the second antenna is received by an RF receiver within the second drill pipe (block 808), which extracts the data from the modulated RF signal (block 810). The extracted data is transmitted to across data cable within the second drill pipe to a second device within the same, second drill pipe (block 812), ending the method (block 814). In at least some illustrative embodiments, the method is used to monitor and control operations of a drill string that is part of a drilling rig such as that shown in FIG. 1.

The above discussion is meant to illustrate the principles of at least some embodiments. Other variations and modifications will become apparent to those of ordinary skill in the art once the above disclosure is fully appreciated. For example, although the embodiments described include RF transceivers that perform the modulating and demodulating of the transmitted and received RF signals respectively, other embodiments can include RF modules that only up-convert and/or down-convert the RF signals, wherein the processing logic performs the modulation and/or demodulation of the RF signals (e.g., in software). Further, although a simple single bus architecture for the processing module is shown and described, other more complex architectures with multiple busses (e.g., a front side memory bus, peripheral component interface (PCI) bus, a PCI express (PCIe) bus, etc), additional interfacing components (e.g., north and south bridges, or memory controller hubs (MCH) and integrated control hubs (ICH)), and additional processors (e.g., floating point processors, ARM processors, etc.) may all be suitable for implementing the systems and methods described and claimed herein. Also, although the illustrative embodiments of the present disclosure are described within the context of petroleum well drilling, those of ordinary skill will also recognize that the methods and systems described and claimed herein may be applied within other contexts, such as water well drilling and geothermal well drilling, just to name some examples. Additionally, the claimed methods and systems are not limited to drill pipes, but may also be incorporated into any of a variety of drilling tools (e.g., drill collars, bottom hole assemblies and drilling jars), as well as drilling and completion risers, just to name a few examples. It is intended that the following claims be interpreted to include all such variations and modifications.

What is claimed is:

1. A wireless communication apparatus, comprising:

a housing configured to be positioned inside of, and proximate to an end of, a drill pipe suitable for use as part of a drill string, the housing comprising:

an antenna configured such that at least one radio frequency (RF) signal propagation path of the antenna is substantially parallel to the central axis of the housing; and an RF module coupled to the antenna and configured to couple to a communication cable, wherein the RF module is configured to provide at least part of a data retransmission function between an RF signal present on the antenna and a data signal present on the communication cable;

wherein a radiotransparent material, which is transparent to RF signals within the operating frequency range of the RF module, is positioned along the circumference, and at or near an axial end, of the housing that is most proximate to the antenna; and wherein at least some axially propagated RF signals, which pass between the antenna and a region axially proximate to said axial end of the housing, pass through the radiotransparent material along said at least one RF signal propagation path.

2. The wireless communication apparatus of claim 1, wherein the radiotransparent material comprises a material selected from the group consisting of a fiber-reinforced polymer and a silicone rubber.

3. The wireless communication apparatus of claim 1, wherein the at least one RF signal propagation path is also substantially parallel to an H-plane associated with the antenna.

4. The wireless communication apparatus of claim 1, wherein the RF module comprises an RF transmitter; and wherein the RF transmitter is configured to receive data encoded within the data signal present on the communication cable, and further configured to retransmit the data by generating and modulating the RF signal present on the antenna.

5. The wireless communication apparatus of claim 1, wherein the RF module comprises an RF receiver that receives the RF signal present on the antenna; and wherein the RF module extracts and retransmits data encoded within the received RF signal for inclusion within the data signal present on the communication cable.

6. The wireless communication apparatus of claim 1, wherein the radiotransparent material is integrated within the housing.

7. The wireless communication apparatus of claim 1, further comprising a spacer configured to be positioned inside, and proximate to the end of, the drill pipe;

wherein at least part of the spacer comprises the radiotransparent material and is positioned along the circumference, and axially adjacent to an exterior surface, of the end of the housing most proximate to the antenna.

8. The wireless communication apparatus of claim 1, further comprising:

one or more batteries that couple and provide power to the RF module; and a power source module that couples to and charges the one or more batteries;

wherein the power source module comprises a power source selected from the group consisting of a kinetic microgenerator, a thermal microgenerator and a wireless energy transfer power source.

9. The wireless communication apparatus of claim 1, wherein the antenna comprises a type of antenna selected from the group consisting of a spike antenna and a loop antenna.

10. A wireless communication system, comprising:

one or more radio frequency radio frequency (RF) transceivers, each RF transceiver housed within a housing that is configured to be positioned inside, and proximate to an end, of a drill pipe within a drill string, and each RF transceiver configured to be coupled by a communication cable to a downhole device positioned within the same drill pipe;

one or more antennas, each antenna coupled to a corresponding RF transceiver of the one or more RF transceivers, each antenna housed within the same housing as the corresponding RF transceiver and each antenna configured such that at least one RF signal propagation path of the antenna is substantially parallel to the central axis of said same housing; and one or more radiotransparent spacers that are transparent to RF signals within the operating frequency range of the one or more RF transceivers, each radiotransparent spacer positioned along the circumference, and at or near an axial end, of a corresponding housing that is most proximate to the antenna within the said corresponding housing;

wherein a first RF signal is received by a first antenna of the one or more antennas through a first radiotransparent spacer of the one or more radiotransparent spacers, the first antenna coupled to a first RF transceiver of the one or more transceivers that extracts receive data from the first RF signal and retransmits the receive data for inclusion in a first data signal transmitted to the downhole device over the data communication cable.

11. The wireless communication system of claim 10, wherein the radiotransparent one or more radio transparent spacers are formed at least in part using a material that comprises a material selected from the group consisting of a fiber-reinforced polymer and a silicone rubber.

12. The wireless communication system of claim 10, wherein the first radiotransparent spacer, corresponding to a first housing comprising the first RF transceiver, is axially adjacent to a second radiotransparent spacer of the one or more radiotransparent spacers that corresponds to a second housing comprising a second RF transceiver of the one or more transceivers; and wherein the second RF transceiver transmits via a second antenna of the one or more antennas the first RF signal received by the first RF transceiver via the first antenna, at least part of the first RF signal propagating from the second antenna, through both the first and second radiotransparent spacers, and to the first antenna along the at least one RF signal propagation path of the first antenna.

13. The wireless communication system of claim 12, wherein the propagation path is also substantially parallel to an H-plane associated with at least one of the first and second antennas.

14. The wireless communication system of claim 12, wherein the magnitude of the first RF signal present on the first antenna is substantially independent of the radial orientation of the first antenna relative to the radial orientation of the second antenna.

15. The wireless communication system of claim 10, wherein the downhole device comprises at least one device selected from the group consisting of a third RF transceiver of the one or more transceivers, a measurement while drilling (MWD) device, a logging while drilling (LWD) device, and a drill bit steering control device.

16. The wireless communication system of claim 10, wherein each radiotransparent spacer is integrated within each corresponding housing.

17. A drill pipe used as part of a drill string, comprising:

at least one housing that is positioned inside of, and proximate to, one of two ends of the drill pipe, the at least one housing comprising:

an antenna configured such that at least one radio frequency (RF) signal propagation path is substantially parallel to the central axis of the drill pipe; and an RF module coupled to the antenna and to a downhole device within the drill pipe;

a communication cable that couples the RF module to the downhole device, the RF module providing at least part of a retransmission function between a data signal present on the communication cable and an RF signal present on the antenna; and at least one radiotransparent spacer that is transparent to RF signals within the operating frequency range of the RF module, and that is positioned along the circumference of, and at or near an axial end of, the at least one housing, said axial end being an end most proximate to the antenna;

wherein at least some axially propagated RF signals, which pass between the antenna and a region axially proximate to the axial end of the corresponding housings, pass through the radiotransparent spacer along the at least one RF signal propagation path.

18. The drill pipe of claim 17, wherein the at least one radiotransparent spacer is formed at least in part using a material that comprises a material selected from the group consisting of a fiber-reinforced polymer and a silicone rubber.

19. The drill pipe of claim 17, wherein the at least one RF signal propagation path is also substantially parallel to an H-plane associated with the antenna.

20. The drill pipe of claim 17, further comprising:

a first housing of the at least one housing, further comprising a first data processing module coupled to a first RF module that further comprises an RF receiver coupled to a first antenna; and a second housing of the at least one housing, the downhole device comprising the second housing, and the second housing further comprising a second data processing module coupled to a second RF module that further comprises an RF transmitter coupled to a second antenna, the first and second data processing modules coupled to each other by the communication cable;

wherein the RF receiver extracts data encoded within a first RF signal received by the RF receiver and provides the data to the first data processing module, which formats and encodes the data within the data signal and transmits the data signal over the communication cable to the second data processing module; and wherein the second data processing module extracts the data from the data signal received from the first data processing module and provides the data to the RF transmitter, which uses the data to modulate and transmit a second RF signal.

21. The drill pipe of claim 17, the at least one housing further comprising a data processing module coupled to the RF module, and the RF module further comprising an RF receiver and an RF transmitter that are both coupled to the antenna;

wherein the RF receiver extracts receive data encoded within the RF signal received by the RF receiver and provides the receive data to the data processing module, which formats and encodes the receive data within the a first data signal and transmits the first data signal over the communication cable to the downhole device; and wherein the data processing module extracts transmit data encoded within a second data signal received from the downhole device and provides the transmit data to the RF transmitter, which uses the transmit data to modulate and transmit a second RF signal.

22. The drill pipe of claim 21, wherein the downhole device comprises at least one device selected from the group consisting of a measurement while drilling (MWD) device, a logging while drilling (LWD) device, and a drill bit steering control device.

23. The drill pipe of claim 17, wherein the communication cable comprises an electrical conductor, and the data signal present on the communication cable comprises an electrical signal.

24. The drill pipe of claim 17, wherein the communication cable comprises a fiber optic cable, and the data signal present on the communication cable comprises an optical signal.

25. A drill string, comprising:

a plurality of drill pipes, each drill pipe mechanically coupled to at least one other drill pipe to form the drill string, and each drill pipe comprising:

at least one housing of a plurality of housings that is positioned inside of, and proximate to, one of two ends of the drill pipe, the at least one housing comprising:

an antenna configured such that at least one radio frequency (RF) signal propagation path is substantially parallel to the central axis of the drill pipe; and an RF transceiver coupled to the antenna;

a downhole device positioned inside the drill pipe;

a communication cable that couples the RF transceiver of the at least one housing to the downhole device, wherein the RF transceiver provides at least part of a retransmission function between a data signal present on the communication cable and an RF signal present on the antenna; and at least one radiotransparent spacer that is transparent to RF signals within the operating frequency range of the RF transceiver, and is positioned along the circumference of, and at or near an axial end of, the at least one housing, said axial end being an end most proximate to the antenna;

wherein a first end of a first drill pipe is mechanically coupled to a second end of a second drill pipe, a first housing of the at least one housing of the first drill pipe positioned within the first end, and the at least one housing of the second drill pipe positioned within the second end; and wherein at least some axially propagated RF signals that pass between the antennas of the first and second drill pipes, also pass through the radiotransparent spacers of both the first and second drill pipes along the at least one RF signal propagation path.

26. The drill string of claim 25, wherein the at least one radiotransparent spacer is formed at least in part using a material that comprises a material selected from the group consisting of a fiber-reinforced polymer and a silicone rubber.

27. The drill string of claim 25, wherein the at least one RF signal propagation path is also substantially parallel to an H-plane associated with at least one of the antennas of the first and second drill pipes.

28. The drill string of claim 25, wherein the magnitude of an RF signal present on the antenna of the first drill pipe is substantially independent of the radial orientation of the antenna of the first drill pipe relative to the radial orientation of the antenna of the second drill pipe.

29. The drill string of claim 25, each of the at least one housing further comprising a data processing module coupled to, and in between, the RF transceiver and the data communication cable;

wherein the downhole device of the first drill pipe generates the data signal present on the communication cable of the first drill pipe and further encodes data within the data signal of the first drill pipe, which is received by the data processing module of the first housing; and wherein the data processing module of the first housing extracts the data from the data signal of the first drill pipe and provides the data to the RF transceiver of the first housing, which modulates with the data, and transmits, the RF signal present on the antenna of the first housing.

30. The drill string of claim 25, each of the at least one housing further comprising a data processing module coupled to, and in between, the RF transceiver and the data communication cable;

wherein the RF transceiver of the first housing extracts data from the RF signal present on the antenna of the first housing and further provides the data to the data processing module of the first housing; and wherein the data processing module of the first housing encodes the data within the data signal present on the communication cable of the first drill pipe and transmits the data signal of the first drill pipe to the downhole device of the first drill pipe.

31. The drill string of claim 25, wherein the downhole device of the first drill pipe comprises at least one device selected from the group consisting of a data processing module within a second housing of the at least one housing, a measurement while drilling (MWD) device, a logging while drilling (LWD) device, and a drill bit steering control device.

32. The drill string of claim 25, wherein the communication cable comprises a cable selected from the group consisting of an electrical cable and an optical cable.

33. A method for wireless transmission of data across a joint mechanically connecting two drill pipes within a drill string, comprising:

receiving, by a radio frequency (RF) transmitter at or near a first end of a first drill pipe, data across a cable from a first device within the first drill pipe;

the RF transmitter modulating an RF signal using the data received;

the RF transmitter transmitting the modulated RF signal using a first antenna, through a first radiotransparent material, and across the joint mechanically connecting the first drill pipe to a second drill pipe;

propagating the RF signal along an RF signal propagation path substantially parallel to the central access of at least one of the two drill pipes receiving, by an RF receiver using a second antenna at or near a second end of a second drill pipe, the modulated RF signal through a second radiotransparent material along said RF signal propagation path, the first and second radiotransparent materials both positioned in a space within the joint between the first antenna and the second antenna;

the RF receiver extracting the data from the modulated RF signal; and the RF receiver transmitting the data across a cable to a second device within the second drill pipe.

34. The method of claim 33, wherein the first and second radiotransparent materials each comprises a material selected from the group consisting of a fiber-reinforced polymer and a silicone rubber.

35. The method of claim 33, wherein the propagating the RF signal further comprises propagating along a path that is also substantially parallel to an H-plane associated with at least one of the antennas of the first and second drill pipes.

36. The method of claim 33, further comprising using the data to control at least part of the operation of the drill string.

37. The method of claim 33, further comprising using the data to monitor at least part of the operation of the drill string.

38. The method of claim 33, wherein the first device comprises at least one device selected from the group consisting of another RF receiver, a measurement while drilling (MWD) device, a logging while drilling (LWD) device, and a drill bit steering control device; and wherein the second device comprises at least one device selected from the group consisting of another RF transmitter, a measurement while drilling (MWD) device, a logging while drilling (LWD) device, and a drill bit steering control device.

* * * * *